United States Patent [19]

Gelfand

[11] 4,258,017

[45] Mar. 24, 1981

[54] VANADIUM REMOVAL FROM FURNACE GASES

[75] Inventor: Dennis B. Gelfand, Wheeling, Ill.

[73] Assignee: UOP Inc., Des Plaines, Ill.

[21] Appl. No.: 60,715

[22] Filed: Jul. 26, 1979

[51] Int. Cl.[3] ..... B01D 53/34

[52] U.S. Cl. ..... 423/210; 423/62; 55/72; 110/203; 110/345; 75/25; 75/84

[58] Field of Search ..... 423/210, 210 M, 62, 423/68; 55/72; 110/342—345, 203, 216; 122/135 A; 75/25, 84, 95

[56] References Cited

U.S. PATENT DOCUMENTS

| | | | |
|---|---|---|---|
| 1,834,261 | 1/1931 | Webster | 110/345 |
| 3,416,882 | 12/1968 | Whigham | 423/68 |
| 4,055,125 | 10/1977 | Mallek | 110/216 |
| 4,119,706 | 10/1978 | Rogers | 423/219 |

*Primary Examiner*—Earl C. Thomas

*Attorney, Agent, or Firm*—James R. Hoatson, Jr.; John F. Spears, Jr.; William H. Page II

[57] ABSTRACT

A method of reducing the corrosiveness of furnace gases by removing vanadium compounds from the furnace gases is disclosed. The gases are contacted with high surface area silica-alumina composites before the gases are passed into the convection heating zone of the furnace. The vanadium compounds are collected on the silica-alumina composites.

6 Claims, 2 Drawing Figures

VANADIUM REMOVAL FROM FURNACE GASES

FIELD OF THE INVENTION

The invention relates to the design and operation of furnaces wherein a vanadium-containing fuel such as a residual fuel oil or coal is burned. The invention more particularly relates to a method of removing vanadium compounds such as vanadium oxides from the combustion gases produced in such a furnace. The invention also relates to the reduction of vanadium corrosion of furnace heating tubes by lowering the vanadium concentration of the hot combustion gas passed over the tubes.

PRIOR ART

It is believed that heretofore it has not been attempted to address the problem of vanadium corrosion of furnace tubes by the removal of vanadium compounds from the hot combustion gas produced in the furnace. Rather, it is believed that it has been attempted to eliminate or minimize corrosion problems through the selection of highly corrosion resistant metals, the application of protective coatings or careful control of operating conditions.

BRIEF SUMMARY OF THE INVENTION

The invention provides a method of reducing or eliminating the formation of corrosive vanadium-containing slags on the heating tubes used in the convection section of a coal or residual fuel oil fired furnace. One embodiment of the invention may be broadly characterized as a method of reducing the vanadium concentration of the gases which are passed through the convection heating zone of a furnace which comprises the steps of removing a combustion gas stream comprising vanadium compounds from the radiant heating zone of the furnace; passing the combustion gas stream through a duct wherein the combustion gas stream is passed through a contacting zone comprising a multiplicity of high surface area contacting bodies which extend across the cross-sectional area of the duct, with the contacting bodies comprising a refractory alumina-silica composite maintained at conditions effective to promote the transfer of vanadium compounds from the combustion gas stream to the contacting bodies; and passing the combustion gas stream into the convection heating zone of the furnace.

The inventive concept also is beneficial in reducing the vanadium content of the flue gas stream which is discharged from the furnace.

BRIEF DESCRIPTION OF THE DRAWING

Referring now to FIG. 1, a large stream of high temperature combustion gases is formed in the lower radiant heating section of a furnace 1. The heat released in the combustion process is used to heat the materials flowing through the lower furnace tubes 2 located in the radiant heating zone of the furnace. The combustion gases pass upward through the porous horizontal screens 3 and 3' and enter an upper portion of the furnace referred to as the convection heating zone. An additional amount of heat is recovered from the combustion gases through the use of the upper furnace tubes 7 located in the convection zone. The concentration of vanadium compounds including vanadium oxides in the combustion gas stream is reduced as the combustion gas stream passes through a bed of silica-alumina spheres 4. The vanadium compounds accumulate on the spheres thereby reducing the formation of a corrosive slag of vanadium and sodium on the upper furnace tubes 7. Periodically quantities of the silica-alumina spheres are removed through conduit 6 and the bed is replenished by fresh spheres which enter by conduit 5.

FIG. 2 illustrates a second embodiment of the invention wherein the silica-alumina contacting bodies are present in the form of horizontal boards or panels 9 which extend across the cross-sectional area of the duct leading from the radiant heating zone to the convection heating section of the furnace 11. The lower furnace tubes 10 located in the radiant heating zone of the furnace and the upper furnace tubes 8 located in the convection heating zone of the furnace and the other components of the furnace itself may be identical to those used in the embodiment shown in FIG. 1. The rising combustion gas stream is caused to travel in a sigmoid path which introduces a degree of turbulence sufficient to insure proper contact between the combustion gas stream and the surface of the contacting bodies.

Figure 1:
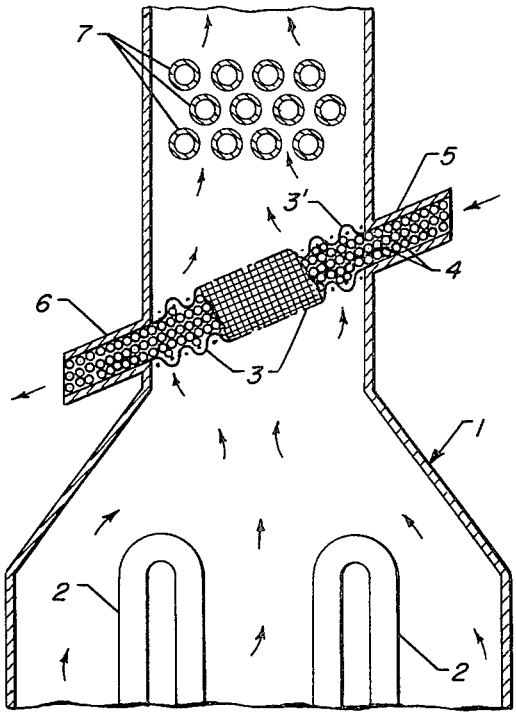
FIG. 1 illustrates an embodiment of the invention wherein the high surface area contacting bodies are in the form of a bed of spheres.

This representation of two embodiments of the invention is not intended to remove from the scope of the inventive concept those other embodiments described herein or which are the result of normal and expected modifications by those skilled in the art.

DETAILED DESCRIPTION

Many residual oils have a substantial vanadium concentration. When these fuels are consumed by combustion in a furnace the vanadium is released, with large amounts of the vanadium being carried upward by the combustion gas in the form of vanadium oxides. These vanadium oxides have a tendency to accumulate on the metallic surfaces present within the furnace and to form a very corrosive slag which contains a mixture of vanadium and sodium. A concentration of 50 ppm. of vanadium in the fuel consumed in the furnace is sufficient to cause a significant corrosion problem. The metals which are attacked by this corrosive slag include many of the common iron alloys including stainless steels. This requires either the use of rather exotic metals containing a high amount of chrome and/or nickel or the application of a protective coating to all exposed metal parts located within the effected portions of the furnace. Both of these solutions to the problem increase the cost of the furnace. Further, the application of a corrosion-resistant coating to the furnace tubes will reduce the rate of heat transfer through the walls of the furnace tubes.

It is an objective of the invention to provide a method of reducing the vanadium slag induced corrosion which is experienced in fuel oil fired furnaces. It is another objective of the subject invention to provide a method of reducing the vanadium concentration of the combustion gases which are passed through the convection heating zone of a fuel oil fired furnace. A further objective of the invention is to provide a method of reducing the vanadium content of the flue gas stream which is discharged from the furnace.

A stream of combustion gas is formed in the lower radiant heating zone of the furnace by the combustion of the fuel. The hot combustion gas rises upward and passes through a convection heating zone wherein a substantial amount of heat is recovered. The objectives of the invention are obtained by causing the rising combustion gas to contact a plurality of high surface area silica-alumina composites. The silica-alumina composites of the present invention are located in that portion of the furnace which acts as a duct or passageway to direct the combustion gas to the furnace tubes located in the convection zone of the furnace.

The silica-alumina composites may contain between about 30 and 70 wt.% alumina, with the remainder being silica. Preferably, the composites will contain between 35 and 50 wt.% alumina. The composites may have virtually any shape. It is preferred, however, that the composites are fabricated from ceramic fiber similar to that commonly used as furnace wall insulation. This material is often referred to as a ceramic fiber blanket or felt. One of the reasons why the composite is preferably formed from this material is that it may be easily attached to all sides of a supporting element. This provides protection for the supporting element and the practice of the invention in this manner does not require the exposure of any additional metallic surface to the combustion gases.

Figure 2:
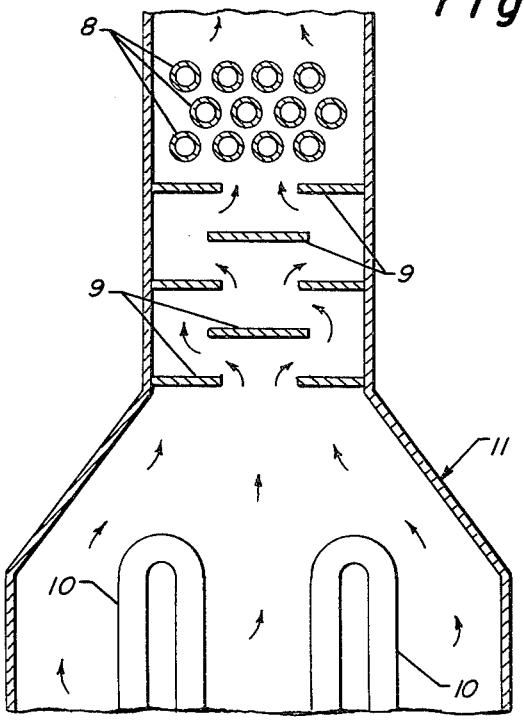
FIG. 2 illustrates a second embodiment of the invention wherein the silica-alumina contacting bodies are in the form of planar horizontal boards which extend across the flow path of the rising combustion gases.

The contacting bodies are preferably fabricated by attaching the ceramic fiber to several horizontal panels located at several different elevations within the duct carrying the combustion gases. The locations of the horizontal panels are staggered both vertically and horizontally in a manner such as that shown in FIG. 2. This requires the rising combustion gas stream to travel along two or more sigmoid (S-shaped) flow paths which promote the contacting of the combustion gases with the silica-alumina composites. This type of contacting also has the advantages of a very low pressure drop or flow resistance and the provision of good admixing. The thickness of the ceramic fiber layer is preferably between 1.0 and 5.0 cm. The panels preferably have a horizontal major axis as shown in the Drawing. The panels need not be coincident with a horizontal plane as they may slope at various angles about a horizontal major axis.

In a second embodiment of the invention the combustion gases are passed through a contacting zone which comprises a bed of alumina-silica spheres. These spheres preferably have the same composition as the previously described composites. The spheres may have a diameter ranging from about 0.5 cm. to about 3.0 cm., with diameters larger than 1.0 cm. being preferred. These larger diameter spheres may be supported by screens having larger slots or openings, with the pressure drop and clogging tendency of the screens thereby being minimized. The use of spheres as the contacting bodies has the advantage of allowing the periodic renewal of the contacting bodies. This is accomplished by removing all or a portion of the spheres which have been used to treat the combustion gases and then replacing the used spheres with unused or regenerated spheres.

The spheres are preferably retained between two parallel screens which are inclined at a substantial angle from horizontal. This high slope is to ensure downward movement of the spheres between the screens after they have been used for any appreciable time and may have become coated with vanadium containing slag, carbonaceous deposits, soot or fly ash. The use of two screens is necessary to provide a uniform thin layer of spheres which extends across the entire cross-sectional area of the duct through which the combustion gases pass. The movement of the spheres may be controlled by valves located on transfer conduits which extend from the volume between the screens to locations on the outside of the furnace. Several transfer conduits and valves are preferably located on each of two opposing sides of the furnace. The contacting bodies used in this and other embodiments may have shapes other than spherical and could be in the form of pellets or extrudates.

The contacting zone is maintained at those conditions of temperature and pressure normally present at locations between the radiant and convection heating zones of the furnace. A temperature greater than about 1250° F. is preferred. The pressure will normally be within the range of from 0.9 to 1.5 atmospheres absolute.

I claim as my invention:

1. A method of reducing the vanadium concentration of flue gas derived from the combustion of a liquid residual oil containing vanadium compounds wherein said flue gas is passed through a radiant heating zone and convection heating zone of a furnace, which method comprises the steps of:

(a) removing said flue gas stream derived from said combustion of said liquid residual oil containing vanadium compounds from said radiant heating zone of said furnace;

(b) passing said flue gas stream removed from said radiant heating zone of said furnace through a passage duct wherein said flue gas stream is passed through a contacting zone comprising a multiplicity of high surface area contacting bodies extending across the cross-sectional area of said passage duct, wherein said contacting bodies comprise a refractory alumina-silica composite maintained at conditions effective to promote the transfer of said vanadium compounds in said flue gas stream to said contacting bodies;

(c) removing said flue gas stream from said passage duct possessing a diminished quantity of said vanadium compounds; and (d) passing said flue gas stream containing a diminished quantity of said vanadium compounds into said convection heating zone of said furnace.

2. The method of claim 1 further characterized in that the high surface area contacting bodies comprise a bed of alumina-silica spheres.

3. The method of claim 2 further characterized in that fresh alumina-silica spheres are periodically added to the bed and in that used spheres are periodically removed from the bed.

4. The method of claim 1 further characterized in that the high surface area contacting bodies comprise a plurality of aluminasilica planar panels located at different elevations and arranged in a manner which requires the combustion gas stream to travel vertically in a sigmoid flow path through the contacting zone.

5. The method of claim 4 further characterized in that the panels are horizontal along their major axis.

6. The method of claim 1 further characterized in that the high surface area contacting bodies comprise from about 35 to about 50 wt.% alumina.

* * * * *